US005758793A

United States Patent [19]

Forsyth et al.

[11] Patent Number: 5,758,793

[45] Date of Patent: Jun. 2, 1998

[54] RECLOSABLE TOP FOR CAN

[75] Inventors: Michael J. Forsyth, Stow; Matthew A. Dudas, Cleveland, both of Ohio; Larry J. Ferguson, Hawthorn Woods, Ill.

[73] Assignee: Weatherchem Corporation, Twinsburg, Ohio

[21] Appl. No.: 704,949

[22] Filed: Aug. 26, 1996

Related U.S. Application Data

[63] Continuation of Ser. No. 594,129, Jan. 31, 1996, abandoned.

[51] Int. Cl.[6] ..... B65D 17/34

[52] U.S. Cl. ..... 220/270; 220/276; 220/791; 215/256

[58] Field of Search ..... 220/254, 270, 220/276, 789, 791, 293; 215/253, 254, 256

[56] References Cited

U.S. PATENT DOCUMENTS

| | | | |
|---|---|---|---|
| D. 305,734 | 1/1990 | Allen | D9/438 |
| 2,102,440 | 12/1937 | Sebell | 215/46 |
| 3,108,708 | 10/1963 | Betner | 220/54 |
| 3,494,500 | 2/1970 | Foster | 220/54 |
| 3,624,789 | 11/1971 | Peyser et al. | 220/97 B |
| 3,927,784 | 12/1975 | Cochran et al. | 215/256 |
| 3,966,080 | 6/1976 | Bittel | 220/269 |
| 3,998,354 | 12/1976 | Song | 220/269 |
| 4,030,630 | 6/1977 | Yealy | 220/258 |
| 4,103,803 | 8/1978 | Irvine | 220/270 |
| 4,146,148 | 3/1979 | Dwinell et al. | 220/270 |
| 4,154,360 | 5/1979 | Smith | 220/258 |
| 4,171,062 | 10/1979 | Allen et al. | 220/270 |
| 4,182,475 | 1/1980 | Freund | 229/5.7 |
| 4,190,175 | 2/1980 | Allen | 220/270 |
| 4,231,486 | 11/1980 | Bock | 220/789 X |
| 4,267,937 | 5/1981 | Piltz et al. | 220/267 |
| 4,433,793 | 2/1984 | Ingemann | 220/276 |
| 4,434,907 | 3/1984 | Ingemann | 220/276 |
| 4,442,950 | 4/1984 | Wilson | 220/269 |
| 4,467,938 | 8/1984 | Allen | 220/270 |
| 4,529,100 | 7/1985 | Ingemann | 220/359 |
| 4,682,706 | 7/1987 | DeVore et al. | 220/276 |
| 4,706,838 | 11/1987 | Von Holdt | 220/270 |
| 4,724,977 | 2/1988 | Cleevely et al. | 220/258 |
| 5,020,686 | 6/1991 | Dutt | 220/276 |
| 5,085,339 | 2/1992 | Roth et al. | 220/269 |
| 5,145,085 | 9/1992 | Yost | 220/269 |
| 5,174,465 | 12/1992 | Luch et al. | 220/288 |
| 5,219,087 | 6/1993 | Christensson | 220/270 |
| 5,249,695 | 10/1993 | Luch et al. | 220/276 |
| 5,271,519 | 12/1993 | Adams et al. | 220/375 |
| 5,303,837 | 4/1994 | Adams et al. | 220/254 |
| 5,348,183 | 9/1994 | Luch et al. | 220/256 |
| 5,395,003 | 3/1995 | Matsuda | 220/270 |
| 5,397,013 | 3/1995 | Adams et al. | 220/256 |
| 5,460,287 | 10/1995 | Cargile et al. | 220/306 |

*Primary Examiner*—Stephen Cronin
*Attorney, Agent, or Firm*—Pearne, Gordon, McCoy and Granger LLP

[57] ABSTRACT

The invention provides a glue-on closure for a composite can or the like that affords an original hermetic seal. A tamper-evident tear band allows the closure to be conveniently opened. Separate end wall and sidewall parts of the closure are configured to provide reclosability with a surface-to-surface contact plug fit.

10 Claims, 3 Drawing Sheets

Fig.2
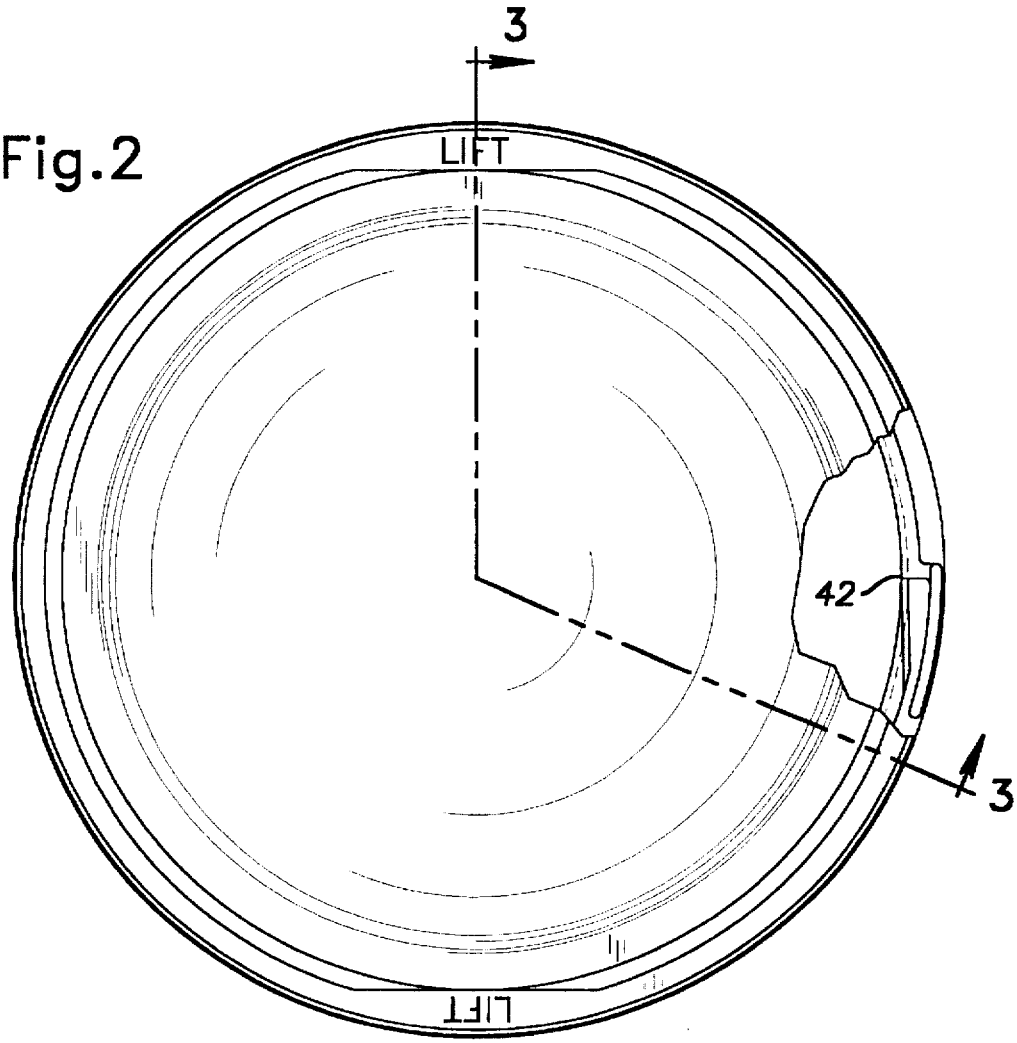
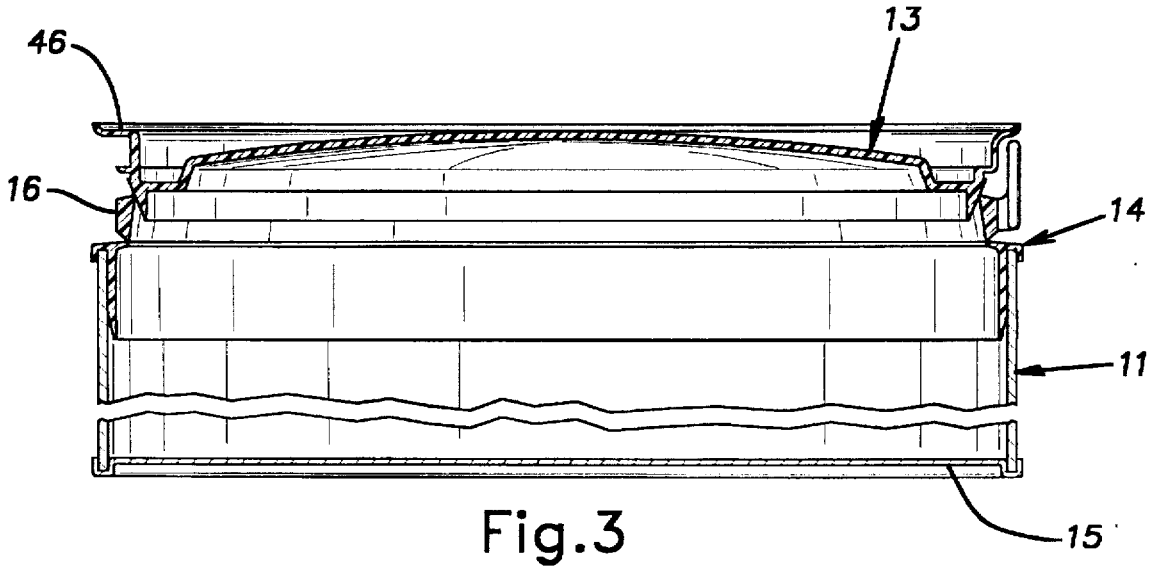
Fig.3

Fig.3A
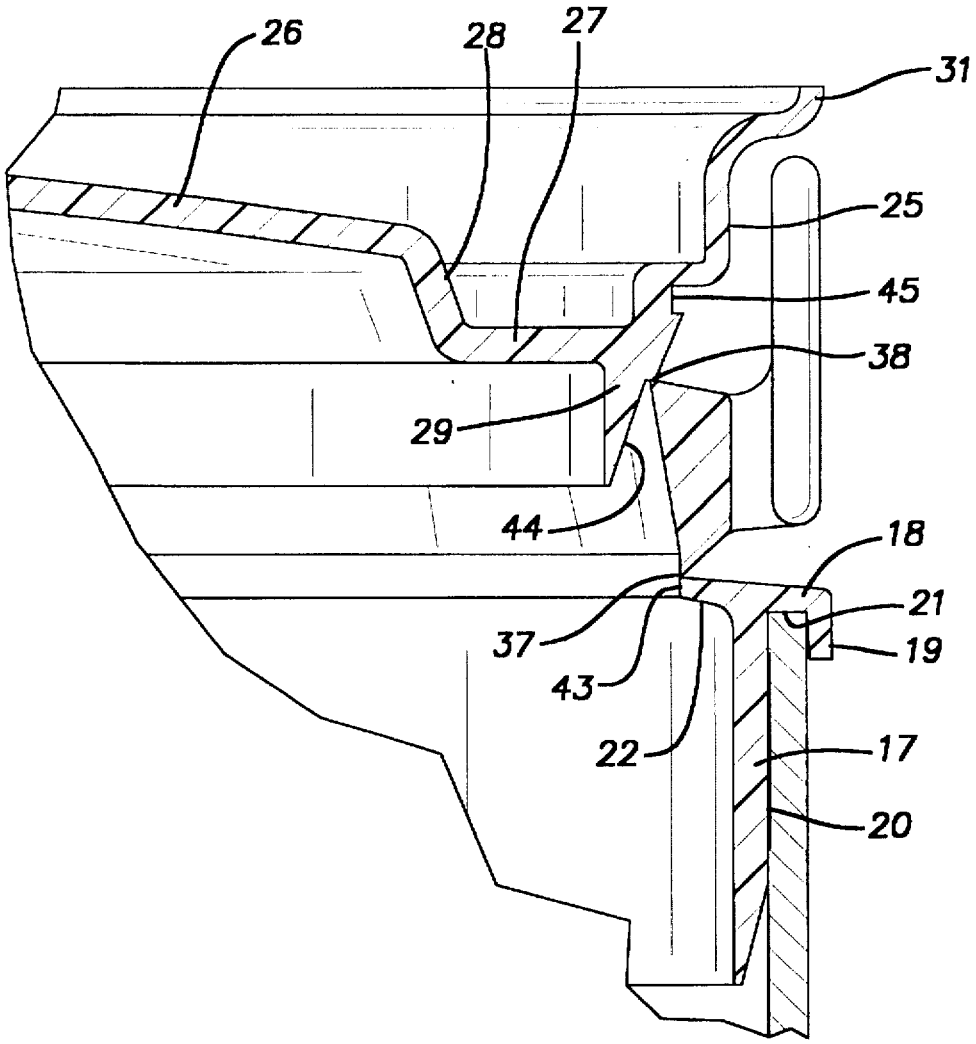
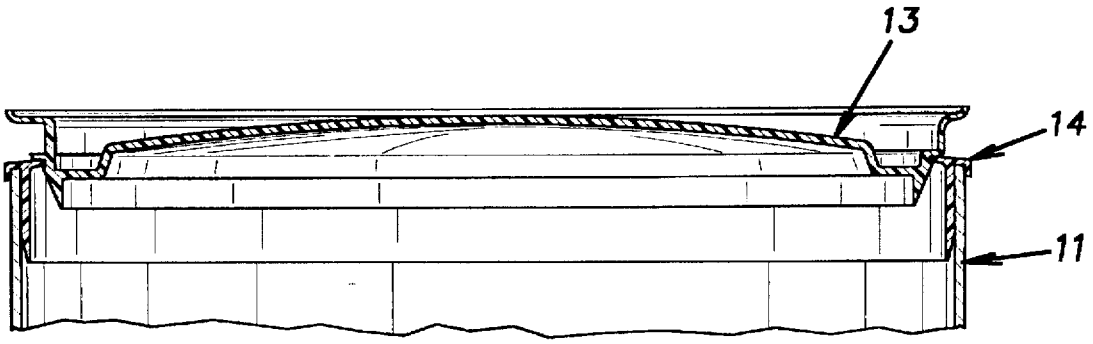
Fig.4

RECLOSABLE TOP FOR CAN

This application is a continuation of prior application Ser. No. 08/594,129 filed Jan 31, 1996, now abandoned.

BACKGROUND OF THE INVENTION

The invention relates to improvements in containers and, more particularly, to a hermetically sealed container end wall construction that can be readily opened by a consumer for access to the contents and thereafter be reclosed for protecting an unused portion of the contents.

PRIOR ART

Rigid containers for food products and other materials are offered in a wide variety of forms and sizes. A common container package includes a cardboard or composite can, usually cylindrical, closed at both ends with a thin but relatively rigid metal or plastic end wall. For access to the contents, the end wall is typically removed by slitting it with a can opener or by other means such with the use of some form of pull tab in combination with a frangible zone.

Where an end wall sheet is severed for access to the contents of the container and where reclosability is desired, a separate over cap has frequently been provided. The separate over cap, of course, adds to the cost of the package. U.S. Pat No. 5,020,686 discloses variations of a one-piece reclosable injection molded plastic closure for round containers.

SUMMARY OF THE INVENTION

The invention provides a one-piece reclosable end wall construction for a container that is economical for the packager and convenient in use for the consumer. The construction includes a sidewall part and an end wall part that originally are integrally joined by a frangible tear band. The tear band allows the end wall part to be severed from the sidewall part without tools and with a low level of manual effort and skill. The band, when it is pulled to open the container concentrates the tearing action to a relatively small area and thereby minimizes the tensile forces that are required of the user.

In the preferred embodiment, the invention is in the form of a closure usable with a thin wall container such as that of a cardboard, composite, metal or plastic can. The sidewall part of the closure is proportioned to closely fit and be hermetically sealed to the end of the container. The closure is preferably sealed in place with a suitable adhesive. The end wall part includes a skirt section originally joined to the sidewall part by the tear band. The skirt section is proportioned to fit into the sidewall part in the manner of a plug to produce a reclosing function. The end wall, when properly installed for reclose on the sidewall, has a groove that couples with a sealing flange on the sidewall. Integrally formed on the end wall part is a flange that serves as a finger grip and that includes a lip which provides a stacking feature for identical containers.

BRIEF DESCRIPTION OF THE DRAWINGS

FIG. 2 is a top view of the closure of FIG. 1;

FIG. 3 is a cross-sectional view of the container of FIG. 1 taken across the planes indicated in FIG. 2 by the lines 3—3;

FIG. 3A is an enlarged fragmentary cross-sectional view of the container; and

FIG. 4 is a view similar to FIG. 3 but with the closure reclosed after a tear band has been removed to initially open the container.

DESCRIPTION OF THE PREFERRED EMBODIMENT

Figure 1:
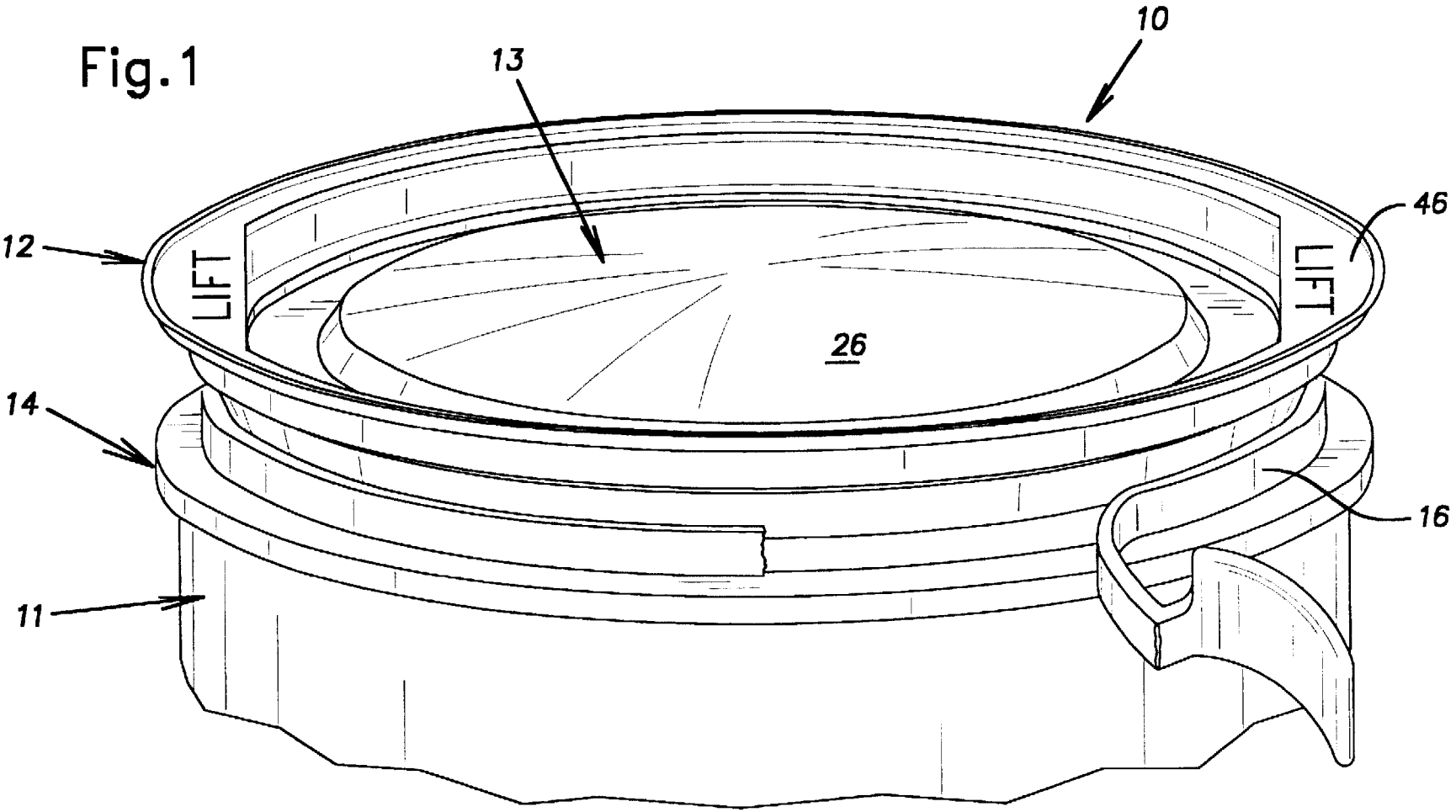
FIG. 1 is a fragmentary perspective view of a container including a closure of the invention demonstrating a condition where a tear band has been partially torn away.

A container construction 10 includes a can 11 and a closure 12 forming an end wall for the can. In the illustrated example, the can 11 has a cylindrical sidewall and being made of cardboard-like material is known in the art as a composite can. Other suitable materials, known in the art, may be used to construct the can 11. The lower end of the can 11 is closed with a metal disc 15 crimped and preferably hermetically sealed onto it in a known manner. The end 15, alternatively, can be made of other known materials and can be integral with the sidewall of the can 11.

The closure 12 is a one-piece structure injection molded of thermoplastic material such as linear low density polyethylene, for example. The closure includes a circular end wall part and a generally cylindrical sidewall part designated by the numerals 13, 14, respectively. Most areas of the end wall and sidewall parts 13, 14 have generally the same nominal wall thickness of 0.025 inches where the closure has a nominal diameter of about 4 inches, for example. A tear band 16 is integrally joined in a circumferentially continuous manner to both the end wall and sidewall parts 13, 14. As shown in particular in FIG. 3A, the sidewall part 14 has a cylindrical skirt 17 with its outside diameter proportioned to fit closely within the inside diameter of the can 11. A lower end of the skirt 17 is slightly tapered to reduce its outside diameter to facilitate insertion into the mouth of the can 11. A flange or shoulder 18 extends radially outwardly from an upper portion of the skirt 17 and a peripheral lip 19, concentric with the skirt 17, depends axially downwardly from the flange 18. The upper region of the skirt 17, the flange 18 and lip 19 form an annular groove or recess 21 that receives the upper peripheral edge of the can 11. Ideally, the upper can edge abuts an underside of the flange or shoulder 18. Typically, the skirt portion 17 of the sidewall part is fixed and is hermetically sealed to the can by a suitable glue or adhesive 20 known in the art or by other known techniques. A circumferential flange 22 extends radially inwardly from the skirt 17.

The circular end wall part 13 has a convex or domed central area 26 that resists vertical compressive loads. The perimeter of the end wall part 13 has an irregular ogee flange 25 surrounding a generally radially extending flat 27 and a conical bridge 28 joined to the central domed area 26. An annular skirt or projection 29 extends axially downwardly from the ogee flange 25. The irregular profile of the periphery of the end wall part 13 imparts a desirable level of stiffness to the part. At the radially outer edge of the ogee flange 25 an upturned lip 31 is formed to provide a stacking feature. The inside diameter of this lip 31 is ordinarily at least as great as the inside diameter of the lip 19 of the sidewall part 14 so that it can receive the bottom of a like container stacked thereon. The lip 31 can be somewhat larger than the lip 19 where the can is fitted with a crimped on end wall 15 as shown so that this end wall of a superposed or stacked identical container can fit into the lip 31 and form a stable stack.

The tear band 16 is integrally joined to the flange 22 on the sidewall part 14 by a thin frangible zone 37 and to the skirt 29 of the circular end wall part 13 by a frangible zone 38. The tear band 16 is peripherally continuous around the perimeter of the closure 12. As shown in the figures, the tear band 16 includes a finger grip or pull tab portion 41 that extends free of remaining elements of the closure parts. The finger grip 41 is disposed radially within the maximum outside diameter of the closure to avoid interference with machine elements when the closure is installed on the can 11 or when the package is otherwise handled by automatic equipment. Adjacent the area where the finger grip 41 joins the tear band proper 16, the tear band is narrowed at a zone 42 to a relatively thin wall of, for example, 0.005 inch measured generally in the radial direction. This narrowed zone 42 provides a local weakened area that facilitates separation of the tear band 16 as described hereinbelow.

Apart from the weakened thin wall zone 42 and an area immediately adjacent it, the tear band 16 has a relatively heavy wall section. The wall or cross-section of the tear band 16 extends generally in the axial direction. As shown, the junctures or frangible zones 37, 38 are spaced apart axially a distance substantially greater than the distance of their radial spacing. The radially thickened geometry and axial orientation of the tear band 16 afford it with a relatively high compressive strength to ensure that the closure has adequate stacking load capacity. Moreover, the frangible zones 37, 38 are advantageously in axial compression when a stacking load is borne by the closure 12.

Ordinarily, the container or can 11 is filled with a product through the end to which the closure 12 is to be attached and then the closure is assembled onto the can with automatic capping equipment. FIG. 3 shows the cap assembled on the can or container 11. The can 11 is opened by the consumer or user of the packaged goods by grasping the pull tab 41 and pulling it radially outwardly. The tear band 16 fractures at the weakened zone 42 in the area where the pull tab 41 is anchored. Continued pulling effort on the tab 41 causes the band 16 to tear, and shear from the point of initial fracture progressively around the perimeter of the closure until it is completely separated from both the sidewall and end wall parts 14, 13. The end wall part 13, at such time, is completely removed from the sidewall part 14 and free access to the container's contents is available. The sidewall part 14 remains secured to the can 11.

The closure 12 is reclosable by pressing the end wall projection 29 into an aperture 43 bounded by the sidewall flange 22. A wide taper angle of an exterior 44 of the skirt or projection 29 and resulting minimum outside diameter of this projection as its lower end facilitates registration of the end wall part 13 to the sidewall part 14. The end wall part 13 is pressed downwardly until the sidewall flange 22 snaps into a groove 45 on the end wall 13 above the tapered projection 29. The flange 22 is dimensioned to plug fit into the groove 45 with an interference fit so that a circumferential surface-to-surface contact seal is provided between the flange and the surface areas of the groove.

The closure is reopened by grasping the flange 25 and pulling the end wall part 13 upwardly free of the sidewall part 14. To facilitate this removal, the flange 25 is altered from its ogee configuration at a pair of diametrally opposed areas 46 associated with the legend LIFT. The modification, shown in cross-section at the left in FIG. 3 provides a relatively wide radially extending flange area which can be more readily gripped than the regular ogee flange geometry forming the majority of the periphery of the end wall part.

It should be evident that this disclosure is by way of example and that various changes may be made by adding, modifying or eliminating details without departing from the fair scope of the teaching contained in this disclosure. For example, the closure can have other geometric end profiles including squares and rectangles. Further, certain aspects of the invention can be applied to container constructions where the sidewall part is an integral part or forms the can and the can is filled from the bottom end and then this end is closed with a bottom wall. The invention is therefore not limited to particular details of this disclosure except to the extent that the following claims are necessarily so limited.

We claim:

1. A container construction comprising a one-piece injection molded thermoplastic body including an end wall part, a sidewall part and a frangible tear band hermetically joining the end wall and sidewall parts, the tear band being separable from the end wall and sidewall parts when subjected to a manually applied pulling force, the sidewall part providing an aperture for access to the container when the tear band is torn away from the parts and the end wall part is lifted away from the sidewall part, the end wall part being reclosable with the sidewall part by having respective sealing surfaces that are in mutual contact around said aperture when said end wall part is lowered onto the sidewall part, the sealing surfaces including a generally radially extending peripheral flange on one of the sidewall and end wall parts and a peripheral groove on the other of the sidewall and end wall parts for receiving the flange with a sealing interference snap fit, the tear band including two frangible zones substantially thinner than the wall thickness of the main areas of the body, the frangible zones being paced apart axially a distance substantially greater than the distance of their radial spacing whereby the tear band has a relatively high compressive strength.

2. The container construction as set forth in claim 1, wherein said tear band includes a finger grip extending free of the remainder of the end wall and sidewall parts.

3. A container construction as set forth in claim 1, wherein said sidewall part has a shoulder for abutting the end of the sidewall of a container.

4. A container construction as set forth in claim 3, wherein said sidewall has an annular groove formed by a pair of concentric wall elements and said shoulder.

5. A container construction as set forth in claim 1, wherein said sidewall part is generally cylindrical and said end wall part is generally circular.

6. A container construction as set forth in claim 1, wherein said end wall and sidewall parts are proportioned such that the end wall forms a plug fit with said aperture.

7. A container construction as set forth in claim 6, wherein said end wall has a depending skirt, said depending skirt being tapered whereby the lower leading end of said skirt is substantially smaller than said aperture to facilitate insertion into said aperture.

8. A container construction as set forth in claim 7, wherein said end wall part has an external groove and said sidewall part has a lip portion to snap into said groove when said end wall part is reclosed onto said sidewall part.

9. A container construction as set forth in claim 1, including a lower end and wherein one of said end wall and sidewall parts includes an upwardly extending peripheral lip larger than said lower end, said lip providing a stacking feature for receiving the lower end of an identical container construction.

10. A container construction as set forth in claim 1, wherein said tear band is disposed between said peripheral flange and said peripheral groove.

* * * * *